US007313883B2

(12) United States Patent
Leitner-Wise

(10) Patent No.: US 7,313,883 B2
(45) Date of Patent: Jan. 1, 2008

(54) MODULAR RECEIVER SYSTEM

(75) Inventor: Paul Leitner-Wise, Alexandria, VA (US)

(73) Assignee: Leitner-Wise Rifle Company, Inc., Springfield, VA (US)

( * ) Notice: Subject to any disclaimer, the term of this patent is extended or adjusted under 35 U.S.C. 154(b) by 315 days.

(21) Appl. No.: 11/188,734

(22) Filed: Jul. 26, 2005

(65) Prior Publication Data

US 2006/0277810 A1 Dec. 14, 2006

(51) Int. Cl.
*F41A 21/00* (2006.01)

(52) U.S. Cl. ..... 42/75.02

(58) Field of Classification Search ..... 42/75.01–75.04
See application file for complete search history.

(56) References Cited

U.S. PATENT DOCUMENTS 1,348,702 A * 8/1920 Gabbett-Fairfax ..... 42/75.02
1,994,489 A * 3/1935 Simpson ..... 42/75.02
2,100,410 A * 11/1937 Pugsley ..... 42/75.03
2,611,297 A * 9/1952 Simpson ..... 89/14.05
3,630,119 A * 12/1971 Perrine ..... 89/189
4,893,426 A * 1/1990 Bixler ..... 42/75.01
5,590,484 A * 1/1997 Mooney et al. ..... 42/111
5,678,343 A * 10/1997 Menges et al. ..... 42/75.02
5,907,919 A * 6/1999 Keeney ..... 42/75.02
6,655,069 B2 * 12/2003 Kim ..... 42/114
6,655,372 B1 * 12/2003 Field et al. ..... 124/83
6,671,990 B1 * 1/2004 Booth ..... 42/75.01
7,036,259 B2 * 5/2006 Beretta ..... 42/75.02
2003/0110675 A1 * 6/2003 Garrett et al. ..... 42/85
2005/0188590 A1 * 9/2005 Baber et al. ..... 42/75.02

FOREIGN PATENT DOCUMENTS

WO WO 9508090 A1 * 3/1995

* cited by examiner

*Primary Examiner*—Troy Chambers
(74) *Attorney, Agent, or Firm*—Reed Smith LLP; Stanley P. Fisher, Esq.; Juan Carlos A. Marquez, Esq.

(57) ABSTRACT

A modular receiver system for firearms comprising a barrel and receiver assembly providing a quick changeover coupling means for connecting the barrel to the receiver, wherein the coupling means comprises a barrel retaining bushing and a pair of opposed cam surfaces on the receiver for hinged engagement of the cam surfaces against the barrel, and wherein the modular receiver system further comprises a rail system for mounting ancillary firearms equipments.

15 Claims, 8 Drawing Sheets

SECTION A-A

DETAIL C

SECTION B-B

MODULAR RECEIVER SYSTEM

FIELD OF THE INVENTION

The present invention relates generally to firearms, and more specifically to a modular receiver system incorporating a method of, and means for, true-quick barrel change system using a unique cammed lever action with "half-moon" cams that lock the barrel in place on the shoulder of the existing barrel extension.

BACKGROUND OF THE INVENTION

Proper alignment of the barrel and receiver in firearms is an important factor bearing upon the reliability, safety, and accuracy of the firearm. It is desirable for the barrel and receiver to be properly aligned and securely joined in such a manner that the two joined components are nearly as rigid as a single member. Prior methods of, and means for, attaching the barrel and receiver include pinning or bolting the barrel to the receiver by means of an external fastener, and attaching the barrel to the receiver by threading. Pinning and bolting do not produce a union that approaches the theoretical rigidity of a single member, thus limiting the accuracy of the firearm. Threading is not practical in firearms adapted to fire rimmed ammunition. Accordingly, a need remains for an improved method, and means for, attaching the barrel of a firearm to the receiver.

A further need exists for a receiver system capable of accepting multiple lengths of barrels or different calibers on the same receiver platform. In prior art, the ability to change calibers or barrel lengths could only be achieved by swapping the entire upper receiver or by changing the barrels at armorer level rather than in the field.

Not only is a means for quick barrel changeover desirable, a barrel changeover means not requiring the use of any tools is especially desirable. Further, a modular receiver system capable of receiving barrels from a variety of manufacturers rather than barrels specifically made for a particular type of receiver is particularly desirable.

SUMMARY OF THE INVENTION

Accordingly, the present invention is directed to a modular receiver system that substantially obviates one or more of the problems due to limitations and disadvantages of the related art. Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as in the appended drawings.

To achieve these and other advantages and in accordance with the purpose of the invention, as embodied and broadly described, the modular receiver system of the present invention provides an improved means for attaching the barrel of a firearm to the receiver and securing them together, wherein the union of these two components more closely approximates the theoretical rigidity of a single member.

More specifically, the present invention provides, in a firearm having a barrel assembly and a receiver, each having front and rear ends, an improved means for attaching the barrel assembly to the receiver, wherein the front end of the receiver is open ended and adapted to mate with the rear end of the barrel assembly and comprises retaining means and two opposed cam surface, the barrel assembly comprising a barrel and a barrel extension, the barrel extension being adapted to interact with the retaining means of the receiver, said retaining means comprising a hardened bushing pressed into the aluminum housing of the receiver having a mating surface, and an attachment means adapted for releasable engagement of the cam surfaces with the barrel.

Another object of the invention is to provide a rail system, which extends over the barrel assembly. The purpose of this is two fold; the first is to act as a heat sink and barrel shroud and the second is to allow the attachment of accessories. In the prior art, accessory rails are usually separate items that are either attached to the barrel or to the receiver. As such, they suffer from movement and flexing caused by the accessories attached to them or by heat caused from using the weapon. Other prior art show integrated rail systems that require unique parts for the ejection port dust cover and barrel lock up. The modular receiver system of the present invention preferably uses standard ejection port cover parts for the AR-15/M-16 weapon system.

Another object of the present invention is to provide a modular receiver system having a non-integral rail system; the rail element being made separately from the receiver unit and subsequently attached to the main receiver body to give the appearance of a single piece unit.

A preferred object of the present invention is to provide a modular receiver system having an integral rail system comprising fixed rails in line with the bore of the receiver at the 12 o'clock and 6 o'clock position, and having removable rails at the 3 o'clock and 9 o'clock positions that can be placed anywhere along the axis of the barrel to the user requirements.

Another object of the present invention is to provide a modular receiver system having a metal bushing through which gas tube passes allowing for the use of existing gas operating system or a gas-piston conversion system if required.

It is yet another object of the invention to provide a modular receiver system in which the barrel mount system, while specific to small arms and rapid barrel changing, can also be adapted to larger weapons and systems, Squad Assault Weapons (SAW) and the like. These weapons have an inherent issue with heat from sustained firing—and the quick change system of the present invention allows for a fast changeover of hot or damaged barrels.

It is still another object of the invention to provide a modular receiver system allowing one or more members of a squad to carry a spare barrel of the opposing force's caliber type, which along with spare magazines of this same caliber, enables the utilization of the opposing force's ammunition stripped from their down soldiers. The present invention allows barrel change-outs that can occur in under a minute.

Other advantages of this invention are that the barrel is free floating, the top rail is continuous and uninterrupted, and the whole package can be made more compact.

It is to be understood that both the foregoing general description and the following detailed description are exemplary and explanatory and are intended to provide further explanation of the invention as claimed. Other objects and features of the invention will become apparent from the following detailed description considered in conjunction with the accompanying drawings. The accompanying drawings are included solely for purposes of illustration and not as a definition of the limits of the invention. Also, the drawings are not drawn to scale, and are merely conceptual in disclosing the preferred embodiments of the invention.

BRIEF DESCRIPTION OF THE DRAWINGS

In the drawings, wherein like reference numerals identify similar elements.

DETAILED DESCRIPTION OF THE PREFERRED EMBODIMENTS OF THE PRESENT INVENTION

Figure 1:
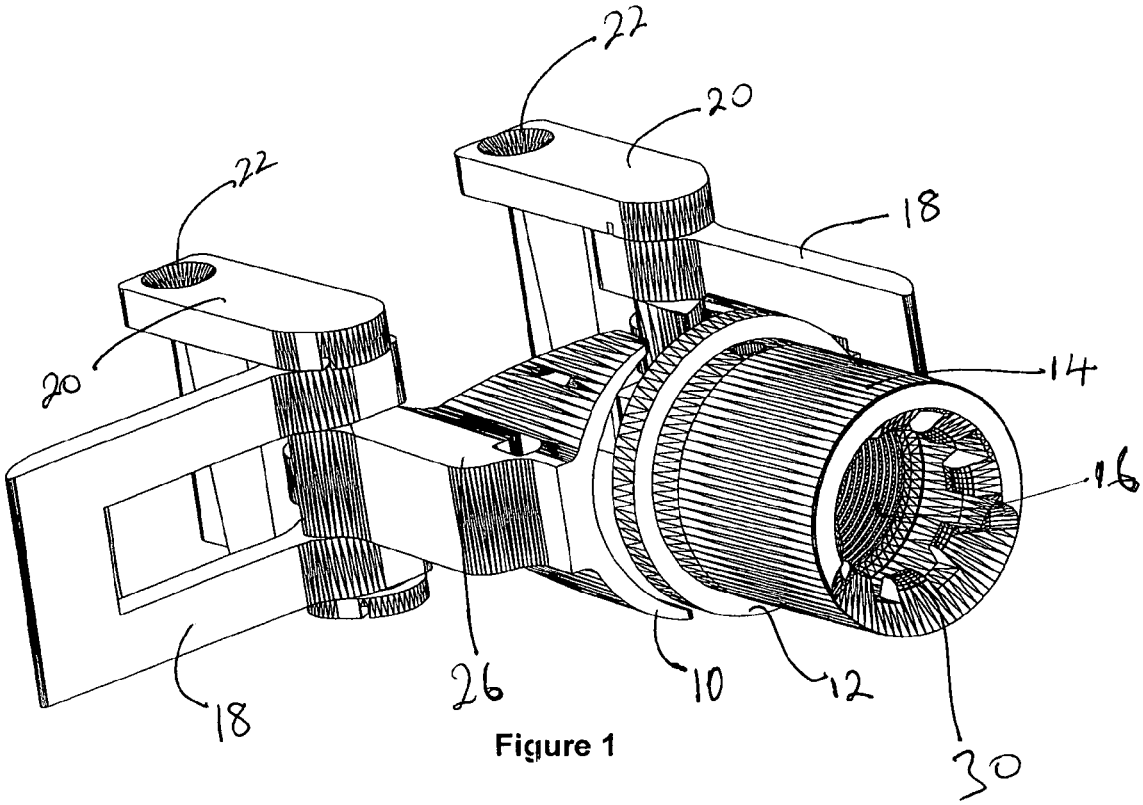
FIG. 1 is an exploded perspective view illustrating the camming latch mechanism on a barrel extension according to the present invention.
Figure 2:
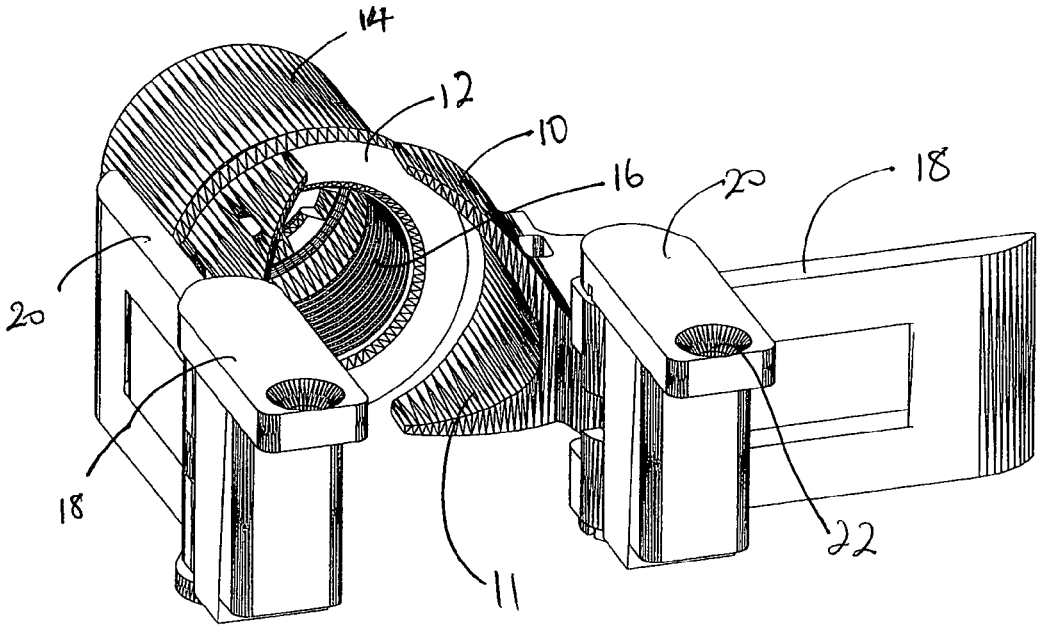
FIG. 2 is another exploded perspective view of the camming latch mechanism of this invention with the barrel removed.
Figure 18:
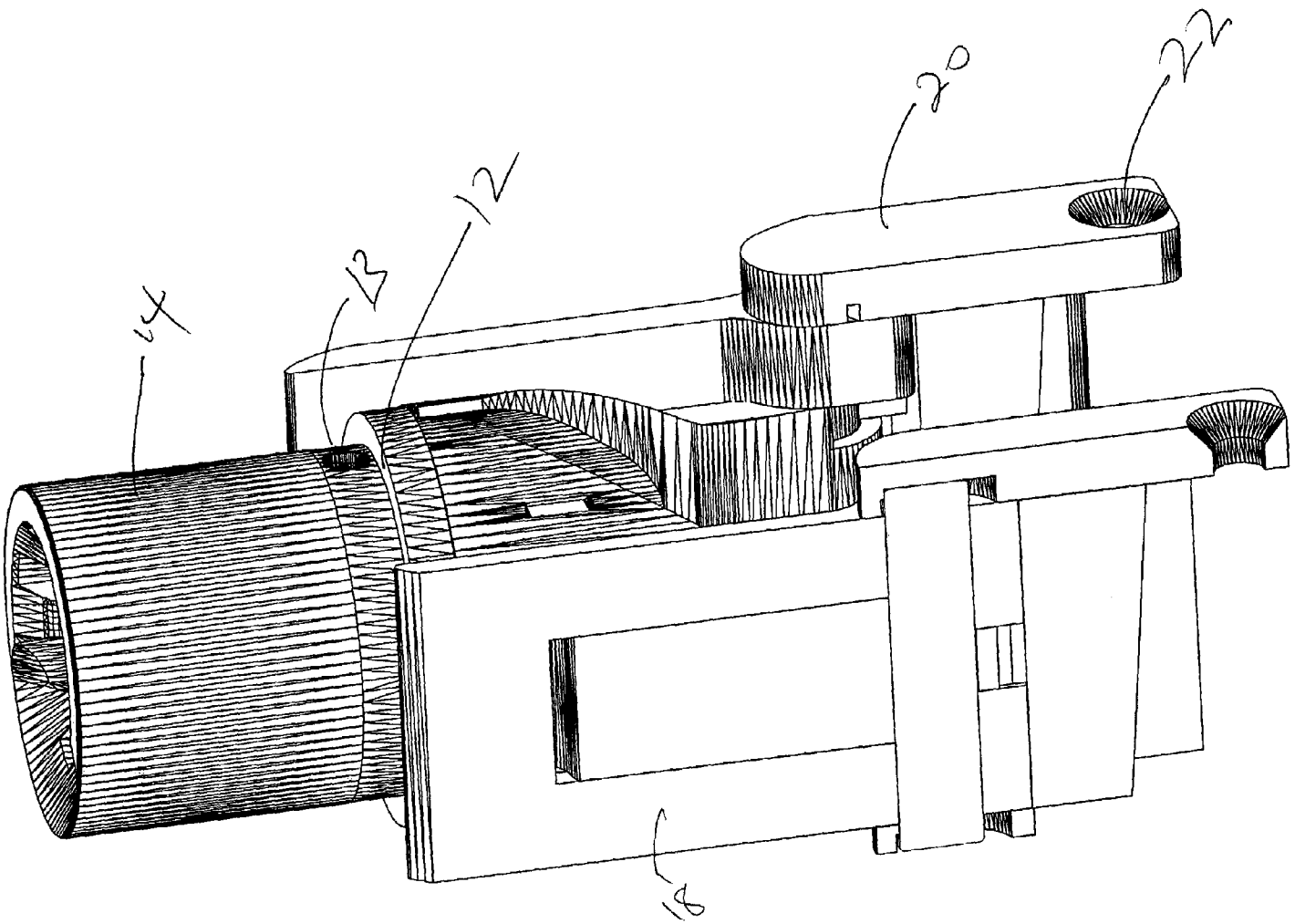
FIG. 18 is an exploded view of the clamping mechanism of the present invention.

Referring now to the drawings of the present disclosure in which like numbers represent the same structure in the various views, FIGS. 1 and 2 and 18 show an exploded view of the barrel retention means comprising the camming mechanism of the present invention. In FIGS. 1 and 2, the barrel assembly (not shown) comprises a barrel and a barrel extension 14. The barrel assembly could be preferably manufactured as one piece in which the barrel is integral with the barrel extension 14 having a flange or shoulder portion 12. In a preferred embodiment, the barrel extension flange or shoulder portion 12 has outside dimensions of about 1.170 inches +/−0.005 inches and the preferred dimensions of the thickness of the shoulder portion is 0.1300 inches +/−0.0005. In another embodiment, the flanged front end of the barrel extension shown in FIG. 2, is internally threaded 16, into which the externally threaded end of the barrel is inserted, securing the barrel and barrel extension together to form the barrel assembly. In yet another embodiment, the barrel extension flange 12 additionally comprises an outwardly extending slot through which the gas tube passes. In yet another embodiment of the invention, the barrel assembly could comprise an externally threaded barrel extension and an internally threaded barrel in which the flange or shoulder portion is embodied by the barrel rather than the barrel extension.

Figure 17:
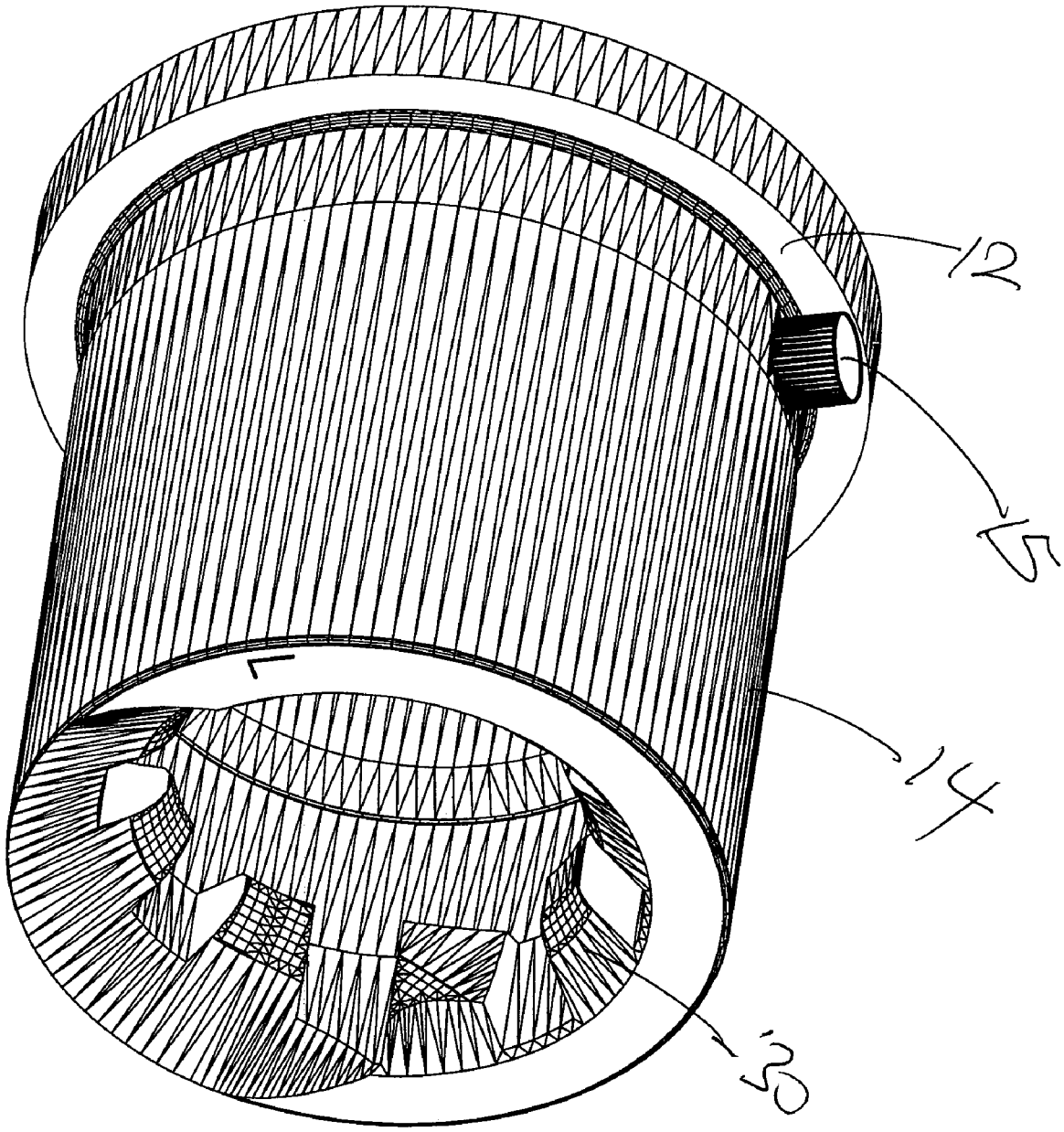
FIG. 17 illustrates a preferred barrel extension of the present invention.

As illustrated in FIGS. 17 and 18, the barrel extension preferably has an indexing hole 13, into which a barrel index pin 15 interferingly fits to permit indexing of the barrel assembly with a corresponding slot on the receiver when fully engaged inside the modular receiver assembly.

Barrels of different lengths can be used. Preferred barrel lengths are approximately 10.5", 14.5", 16" lengths or any length that the user may require determined by application and or caliber. The gas tube is of standard diameter, but may be straight or kinked like the standard gas tube. The gas tube is supported at the receiver end by the rigidity of the tube and the gas in the receiver itself. A preferred barrel assembly of the present invention shall comprise a low profile gas block. The gas block is cross-pined to the barrel and the gas tube is held either via a standard roll pin.

Figure 7:
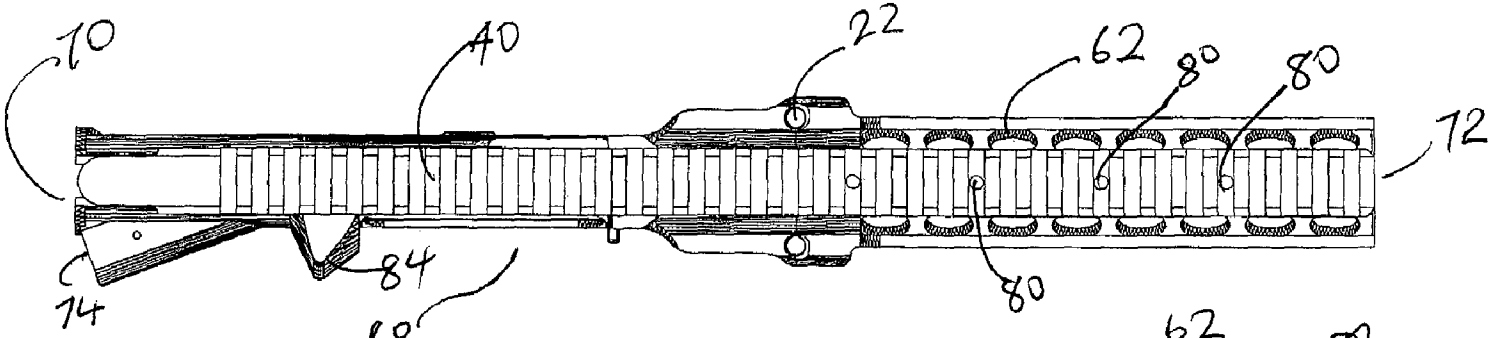
FIG. 7 is a top perspective view of the modular receiver system of the present invention.
Figure 8:
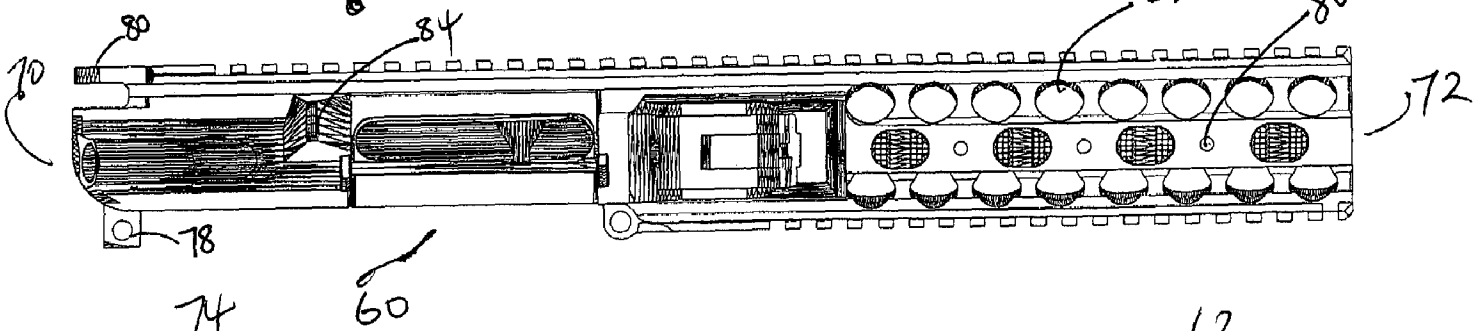
FIG. 8 is a cross-sectional view of the modular receiver system of the present invention.
Figure 9:
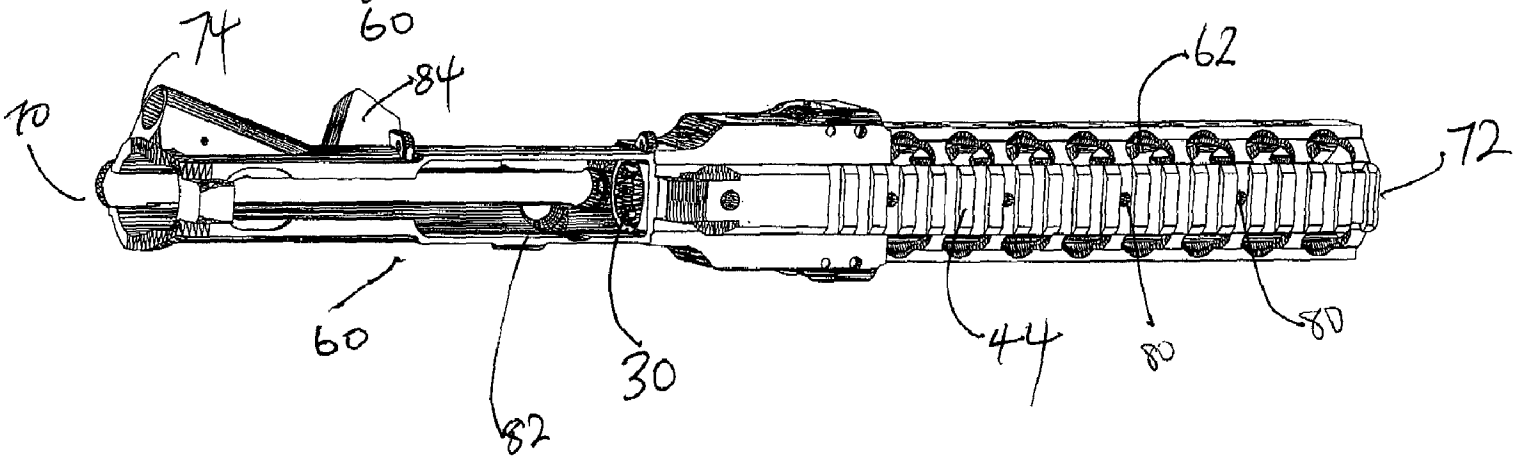
FIG. 9 is a bottom perspective view in partial cross-section of the modular receiver system of the present invention.
Figure 11:
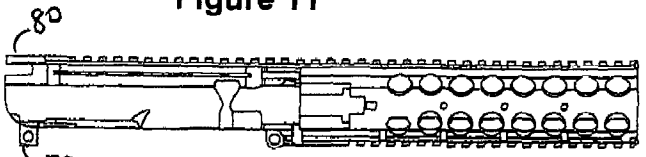
FIG. 11 is a horizontal cross sectional view of the modular receiver system of FIG. 7.

In FIGS. 7, 8 and 9, the modular receiver assembly 60, has a front end 70, a rear end 72 through which the barrel is inserted, and an ejection port (not shown) formed in the side thereof. The ejection port is adapted to permit lateral movement of a bolt handle attached to a bolt (not shown), and to permit the ejection of the casing of a round of ammunition after the round has been fired.

Figure 4:
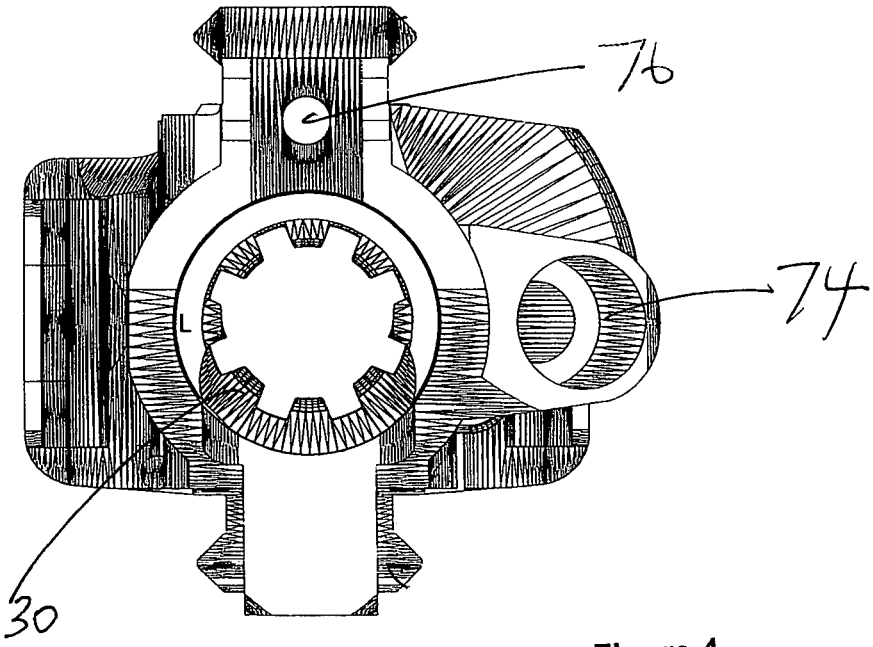
FIG. 4 is a front perspective view of the modular receiver system of the present invention.
Figure 5:
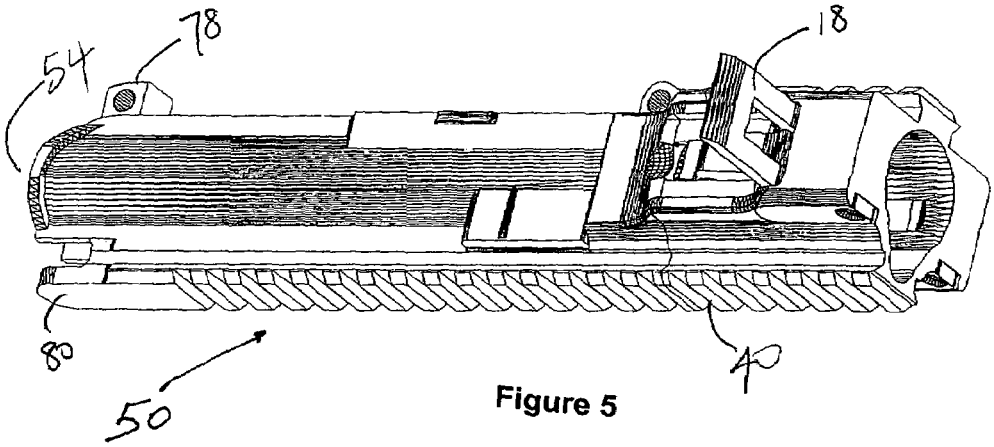
FIG. 5 is a side perspective view showing the rail extension portion of the modular receiver system of the present invention.
Figure 6:
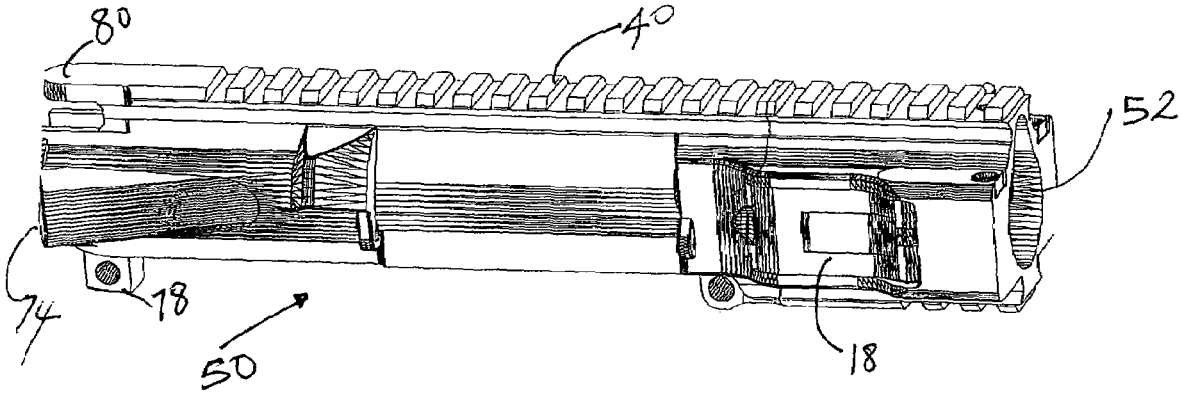
FIG. 6 is another side perspective view of the embodiment of FIG. 5.

The front end 70 of the modular receiver assembly 60 comprise the forward assist housing 74 containing a plunger that can be used to force the bolt and the bolt carrier into battery. Also shown in FIG. 4 is the gas hole designed to permit entry of the gas tube or operating rod as well the lug 78 for receiving the pivot pin allowing the upper receiver to be attached to the lower receiver. FIGS. 5, 6 and 8 also show the slot 80 for the charging handle, which allows opening of the bolt in order to load or unload ammunition into the chamber of the weapon. Also shown at the lower receiver end 70 of the modular receiver assembly is the cam pin recess 82 that allows the cam pin to rotate in clearance as the bolt opens and closes. See FIGS. 7-9, which also shows the shell deflector 84. The shell deflector is designed to deflect fired empty shells away from the faces of left-handed shooters.

Figure 13:
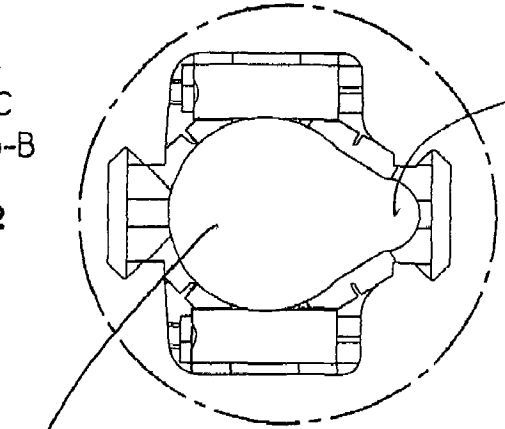
FIG. 13 is an exploded view of FIG. 12.
Figure 12:
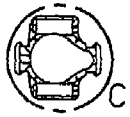
FIG. 12 is a transverse cross-sectional view of the modular receiver system of FIG. 7.
Figure 10:
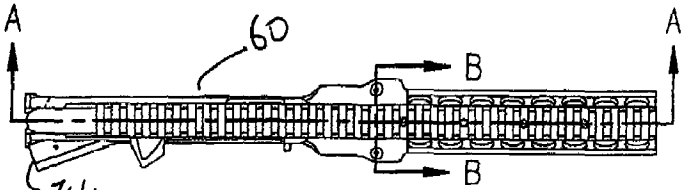
FIG. 10 is a top perspective view of the modular receiver system corresponding to FIG. 7.
Figure 14:
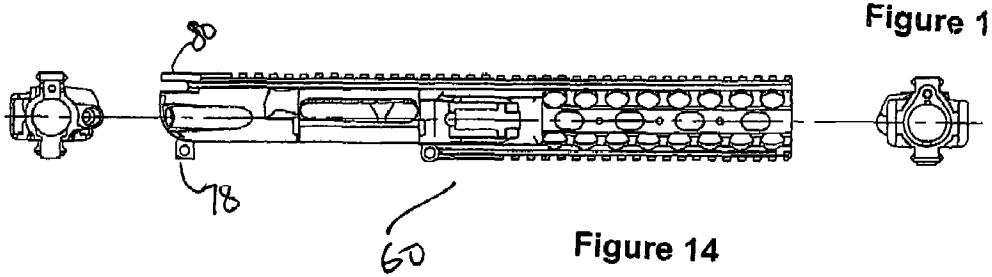
FIG. 14 is a side perspective view of a modular receiver system of the present invention showing transverse cross-sectional views.
Figure 15:
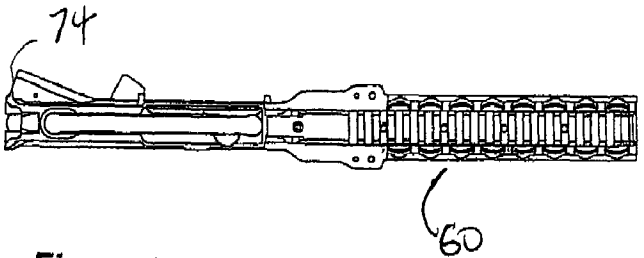
FIG. 15 is a bottom perspective view of a modular receiver system of the present invention corresponding to FIG. 9.

The barrel end 72 of the modular receiver system is open ended with an ellipsoidal aperture comprising a substantially circular portion 66 and a semi-elliptical portion 68 adapted to interact with the barrel assembly having a horizontally disposed gas tube. See FIG. 13. The barrel end 72 of the modular receiver system also comprises screw holes for accessories 80. It is preferred to be Helicoil® ¼×20" thread pitch with locking "upset" in one coil. Similarly, the holes 62 at the same barrel end of the modular receiver assembly are designed for air cooling and lightening the weight of the receiver.

The interior of the rear end of the barrel extension has steel lugs 30, adapted to interact with the rotating bolt. In a preferred embodiment, the lugs 38 are metallic and preferably made of 8620 steel, casehardened, 4140 steel, and 4340 steel.

Also, at the front end of the receiver assembly is the primary retaining means comprising two opposing cam members or C-clamps 10, comprising the cam surfaces 11, and hingedly mounted via the slottable holes 22 on the body of the receiver assembly 60. Each cam surface 11 has a circumferentially disposed half moon configuration taperedly extending from the barrel end of the receiver 72 towards the front end 70.

Figure 3:
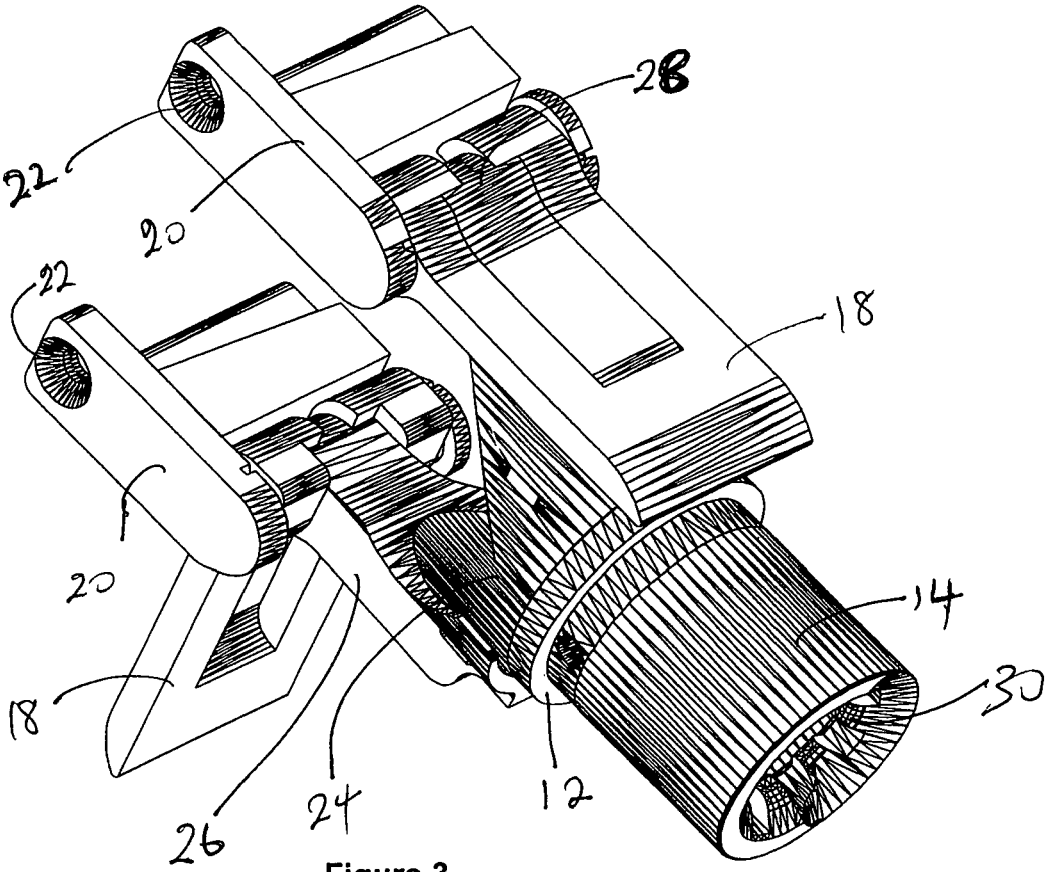
FIG. 3 is another perspective view of the camming latch mechanism of this invention.

The embodiments of the primary retaining means shown comprises an inwardly directed extension arm 26 hingedly 28 connected to a pivotable cam latch 18 and a non-pivotable mounting member 20. The holes 22 are for slottable engagement of the clamping mechanism with the receiver body. The pivotable cam latch 18 pivots around the mounting member 20 and the extension arm by means of a dowel pin whose throw is about 0.080 inches. The primary retaining means is made of steel. See FIGS. 1-3.

Figure 16:
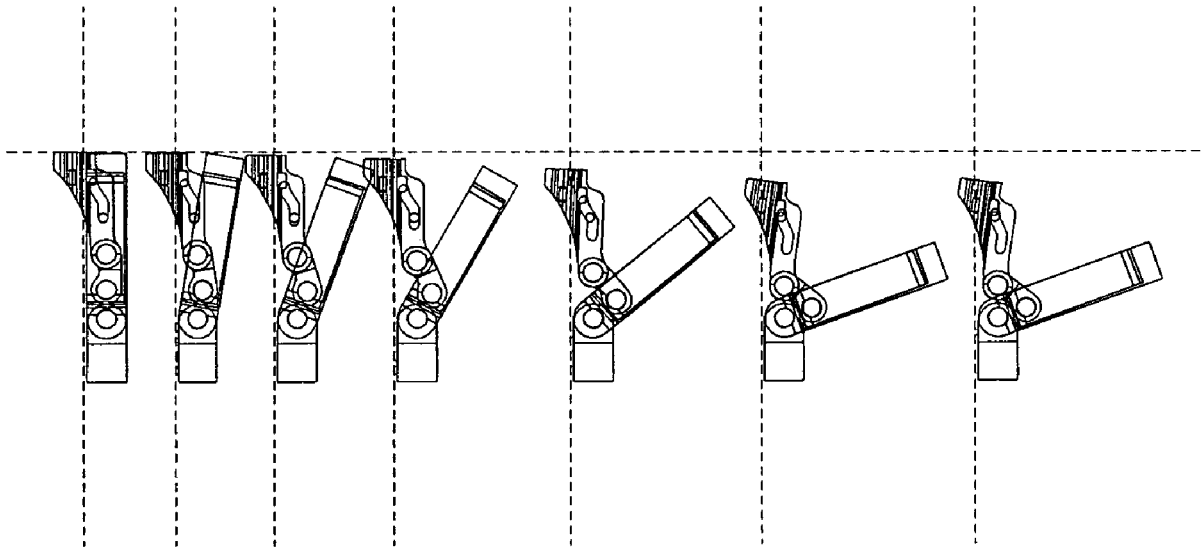
FIG. 16 illustrates the engagement and disengagement motion of the clamping mechanism of the present invention.

Pivoting the cam latch 18 in an inward direction towards the receiver assembly permits a rearward movement of the arm 26 and the cam members 10 until the rear end of the cam members 10 contacts the top end of the barrel extension flange 12, causing the opposed cam surfaces 11 to also grip the barrel 24. Similarly, to disengage the barrel from the modular receiver, the cam latch is pivoted outwards to release the primary retaining clamping means and the barrel is then manually urged out and away from the receiver. FIG. 16 illustrates the motion of the clamping mechanism. Inside the receiver housing, there is a slot (not shown) where the clamping member 10 rides as it is being engaged and disengaged from the barrel.

When the receiver and barrel are connected, the opening in the front of the receiver is defined by the barrel, and the semi-elliptical gas tube channel 68. The barrel retaining mechanisms are fully contained within the body of the receiver and there are no parts external to the aluminum housing, and no tools are required to engage and disengage the clamping mechanism.

Other embodiments of the present invention include rail systems 40, 44, optionally integrally part of the receiver assembly, extending outwardly along the length of the barrel as shown in FIGS. 7-9. In a preferred embodiment, the rail platform and receiver are machined out of one piece of aluminum, instead of having a separate receiver and rail system. FIGS. 5 and 6 illustrate an embodiment of the invention comprising a separate receiver system 50 in which the rear end 52 is connected to a separately manufactured rail portion of the modular receiver system. Both portions can be joined in many ways including welding and threading. The entire modular receiver assembly can be made by aluminum forging, billet, extrusion or casting may be used, with forging, billet or extrusion being the preferred method. The preferred aluminum material is T7075 Aluminum.

As shown in FIGS. 7-9, fixed rails in line with the bore of the receiver are placed in the 12 o'clock 40 and 6 o'clock 44 positions. The 12 o'clock rails 40 cover a substantial portion of the length of the top of the receiver. The preferred rail type is Mil-STD 1913. In any case the preferred railing conforms to the standard methods of dimensioning accessory mounting rails for small arms weapon systems and the preferred dimensioning and tolerances should be in conformity with military standards. The accessory mounting rails of FIGS. 7-9 are in conformity with MIL-STD-1913. Also movable rails at the 3 o'clock and 9 o'clock positions can be placed anywhere along the axis of the barrel to the user requirements. In one embodiment, the 3 o'clock and the 9 o'clock rails are attached by means of button head cap screws screwed into Helicoil threads on the axis of the bore line, wherein the length of the rail corresponds to the user specifications.

The improved mechanism of the present invention, in its various possible embodiments, provides a means of connecting a barrel assembly to a receiver to produce a more rigid union that more closely approximates a single member. The present invention, with the cam retaining means, will lock the barrel assembly and receiver together. By means of the half-moon cam surfaces contacting the barrel and resting on the barrel extension flange, a two directional clamping force is achieved. The resting of the cam surface on the barrel extension flange provides a lateral clamping force that complements the radial clamping force of the cam surfaces. Furthermore, although handguards are not shown in the illustrations, it is understood by one of skill in the art that handguards are rail covers that may be configured in many ways and lengths to individual requirements, providing a griping surface and heat protection for the user's hands.

It will be apparent to those skilled in the art that various modifications and variations can be made to the present invention without departing from the spirit or scope of the invention. Thus, it is intended that the present invention cover the modifications and variations of this invention provided they come within the scope of the appended claims and their equivalents. Accordingly, the invention is not limited by the embodiments described above which are presented as examples only but can be modified in various ways within the scope of protection defined by the appended patent claims.

What is claimed is:

1. A modular receiver system for firearms comprising a receiver assembly, having a front and rear end, wherein the rear end of the receiver is adapted to mate with the rear end of a barrel assembly, and the barrel assembly comprises a barrel and a flanged barrel extension, and a primary retaining means comprising a pair of opposed cam surfaces hingedly mounted and wholly contained in the receiver assembly, and adapted to engage the barrel assembly in a rigid position, wherein said rigidity is attained by lateral force exerted on the flange of the barrel assembly and circumferential force exerted by the opposed cam surfaces on the barrel.

2. The modular receiver system of claim 1, wherein the barrel assembly comprises a barrel and flanged barrel extension, each having front and rear ends, wherein the front end of the barrel extension is adapted to be operatively connected to the rear end of the barrel.

3. The modular receiver system of claim 2 wherein the barrel extension has a threaded aperture adapted to engage a threaded rear end of the barrel.

4. The modular receiver system of claim 2 wherein the barrel assembly is a single unit comprising a flanged barrel.

5. The modular receiver system of claim 4, wherein the flange of the barrel extension is flush with the front end of the barrel extension.

6. The modular receiver system of claim 1, wherein the barrel extension has an indexing hole wherein an indexing pin interferingly fits for slottable engagement with an indexing hole or slot on the receiver assembly.

7. The modular receiver system of claim 1, wherein the primary retaining means further comprises a pair of extension arms, a pair of pivotable members, and a pair of mounting member, said opposed cam surfaces mounted at the end of the extension arms.

8. The modular receiver system of claim 7, wherein said extension arms, said pivotable members, and said mounting members are hingedly connected.

9. The modular receiver system of claim 7, wherein said primary retaining means are made of steel.

10. The modular receiver system of claim 1, wherein said primary retaining means are slottably mounted on the receiver assembly.

11. The modular receiver system of claim 1, wherein said primary retaining means is wholly contained within the receiver.

12. The modular receiver system of claim 1, further comprising a rail system extending along the bore line of the barrel assembly.

13. The modular receiver system of claim 12, wherein the rail system comprises a top and bottom rail.

14. The modular receiver system of claim 13, further comprising additional rails.

15. The modular receiver system of claim 12, wherein the rail system conforms to U.S. military standards for accessory mounting rails.

* * * * *